US006317907B1

(12) United States Patent
Wang

(10) Patent No.: US 6,317,907 B1
(45) Date of Patent: Nov. 20, 2001

(54) SAFETY DEVICE FOR A COLLAPSIBLE PLAYPEN

(76) Inventor: Kun Wang, No. 56, Min Sheng Street, Feng-Yuan (TW), 42041

( * ) Notice: Subject to any disclaimer, the term of this patent is extended or adjusted under 35 U.S.C. 154(b) by 0 days.

(21) Appl. No.: 09/372,640

(22) Filed: Aug. 9, 1999

(51) Int. Cl.[7] ..... A47D 7/00
(52) U.S. Cl. ..... 5/99.1; 5/93.1; 5/98.1
(58) Field of Search ..... 5/99.1, 93.1, 98.1

(56) References Cited

U.S. PATENT DOCUMENTS

| | | | | |
|---|---|---|---|---|
| 5,485,655 | * | 1/1996 | Wang | 5/98.1 X |
| 5,611,634 | * | 3/1997 | Wang | 5/99.1 X |
| 5,867,851 | * | 2/1999 | Mariol et al. | 5/99.1 |
| 5,911,653 | * | 6/1999 | Cheng | 5/99.1 |
| 6,065,163 | * | 5/2000 | Hung | 5/99.1 |
| 6,125,483 | * | 10/2000 | Stroud et al. | 5/99.1 |

* cited by examiner

*Primary Examiner*—Michael F. Trettel
*Assistant Examiner*—James M Hewitt

(57) ABSTRACT

A safety device for a collapsible playpen is provided. The playpen includes four upper corner seats, four lower corner seats, four vertical posts respectively secured at their upper ends to the upper corner seats and at their lower ends to the lower corner seats, four upper railings, each or which includes a pair of identical rods pivoted together by first connecter, a central seat positioned at a lower center of the playpen, four drive rods ariented diagonally and each having inward ends pivoted to the central seat and outward ends pivoted to the lower corner seats respectively, a pair of linking rods each having two rods or equal length pivoted together by a second connecter, a strip connecting the linking rods and extending through a pair of hooks on the top of the central seat and a casing attached to the peripheral portion of the playpen. Four reinforcement rods are disposed under the drive rods to prevent the top of the vertical posts from falling inward so as to prevent the playpen from an inadvertent collapse.

4 Claims, 9 Drawing Sheets

SAFETY DEVICE FOR A COLLAPSIBLE PLAYPEN

BACKGROUND OF THE INVENTION

The present invention relates to nursery apparatus and more particularly to a safety device for a collapsible playpen which can prevent the playpen from unintentional-collapse by a user.

For ease in transport, collapsible playpens are therefore available on the market. My previous disclosure of a Control Device for Folding and Expanding a Base Portion of a Playpen, U. S. Pat. No. 5,497,517 as shown in FIG. 1, includes four upper corners 11, four lower corners 12, a base portion 13, four upper railings 14, four drive posts 15, having ends respectively pivoted at the lower corners 12 and the base portion 13, four vertical stands 18 respectively secured to the upper and lower corners 11 and 12, a pair of linking rods 16 pivoted to the four drive posts 15, a pair of resilient strips 17 connected to the base portion 13 and the linking rods 17 and a casing 19 covering the peripheral portion of the playpen with its bottom placed over the top of the base portion 13.

When the base portion 13 is pulled upward and the upper railings 14 are pushed downward, the four vertical stands 18 will move centripetally thereby folding the playpen into a small rectangular form.

However, if any of the upper railings 14 is inadvertently pushed downward (as shown in FIG. 2) by a user, the vertical stands 18 will move inward to collapse the playpen. This dangerous situation will occur because the playpen lacks a safety device.

SUMMARY OF THE PRESENT INVENTION

The present invention has a main object to provide a safety device for a collapsible playpen which can prevent the vertical stands from collapsing inward in order to protect a child in the playpen.

Another object of the present invention is to provide a safety device for a collapsible playpen which controls the four vertical stands to move inward in a parallel fashion during collapse of the playpen.

A further object of the present invention is to provide a safety device for a collapsible playpen which allows the playpen to be collapsed quickly and easily.

Accordingly, the safety device of the present invention includes four additional reinforcement posts under the drive posts or under the upper railings or under both of the drive posts and the railings of the conventional playpen of FIG. 1. The four additional reinforcement posts provide appropriate tension to prevent the upper portion of the vertical stands from falling inward in order to prevent the playpen from inadvertent collapse.

The present invention will be more fully understood by reference to the following detailed description thereof when read along with the attached drawings.

DETAILED DESCRIPTION OF THE PREFERRED EMBODIMENT

Figure 1:
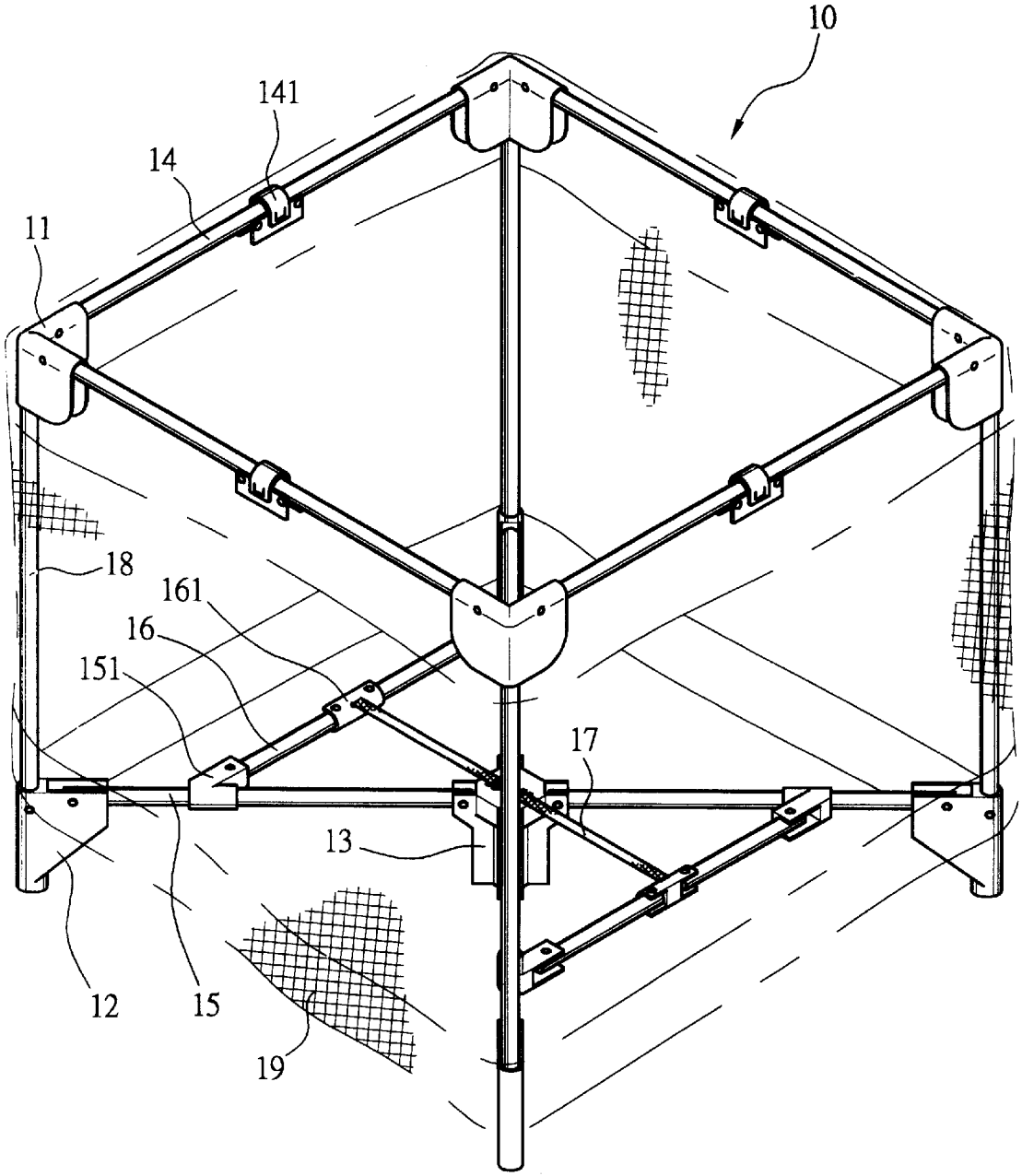
FIG.1 Prior Art
FIG. 1 is a perspective view of a collapsible playpen of the prior art.
Figure 2:
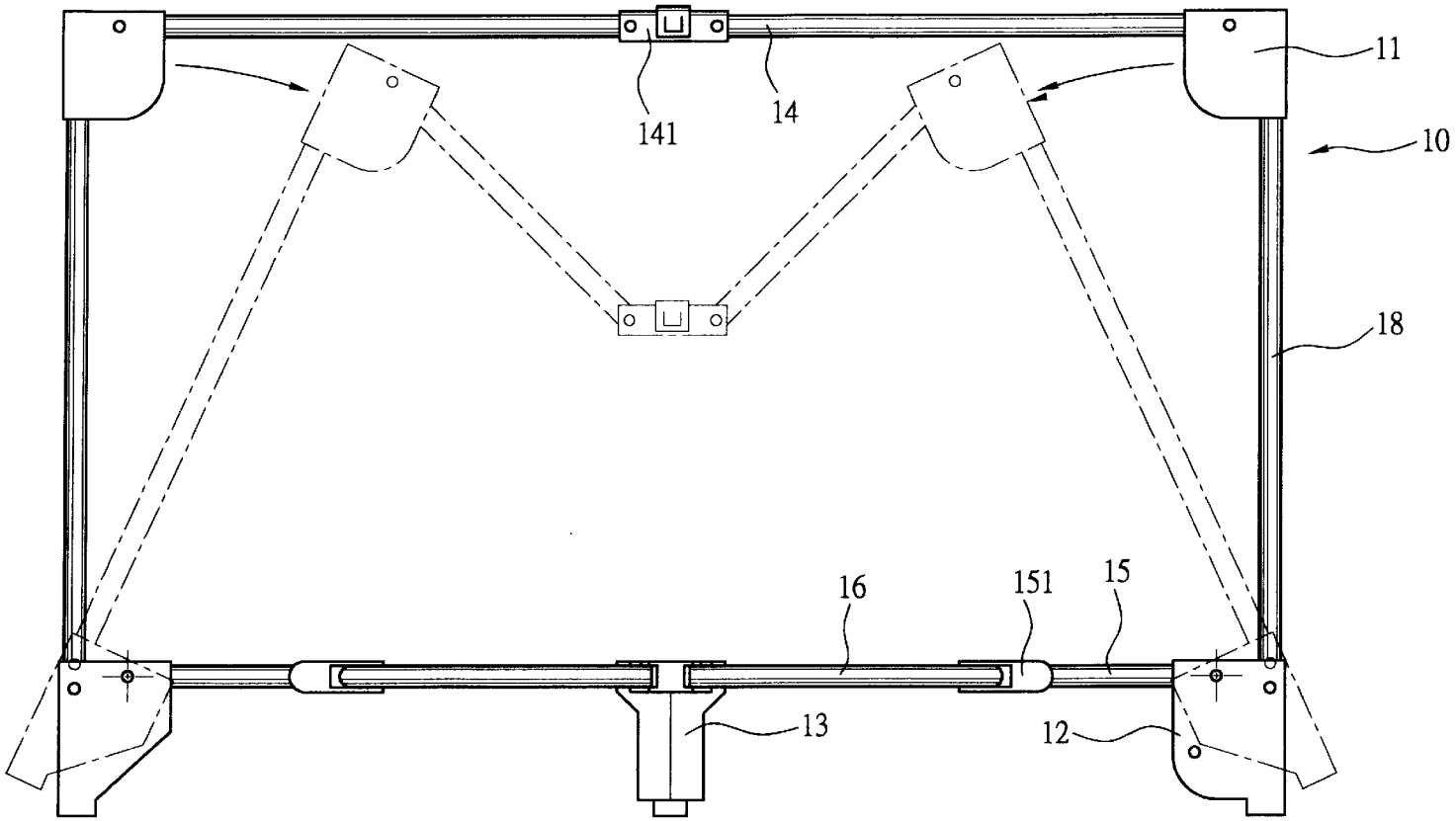
FIG.2 Prior Art
FIG. 2 is a side view of FIG. 1.
Figure 3:
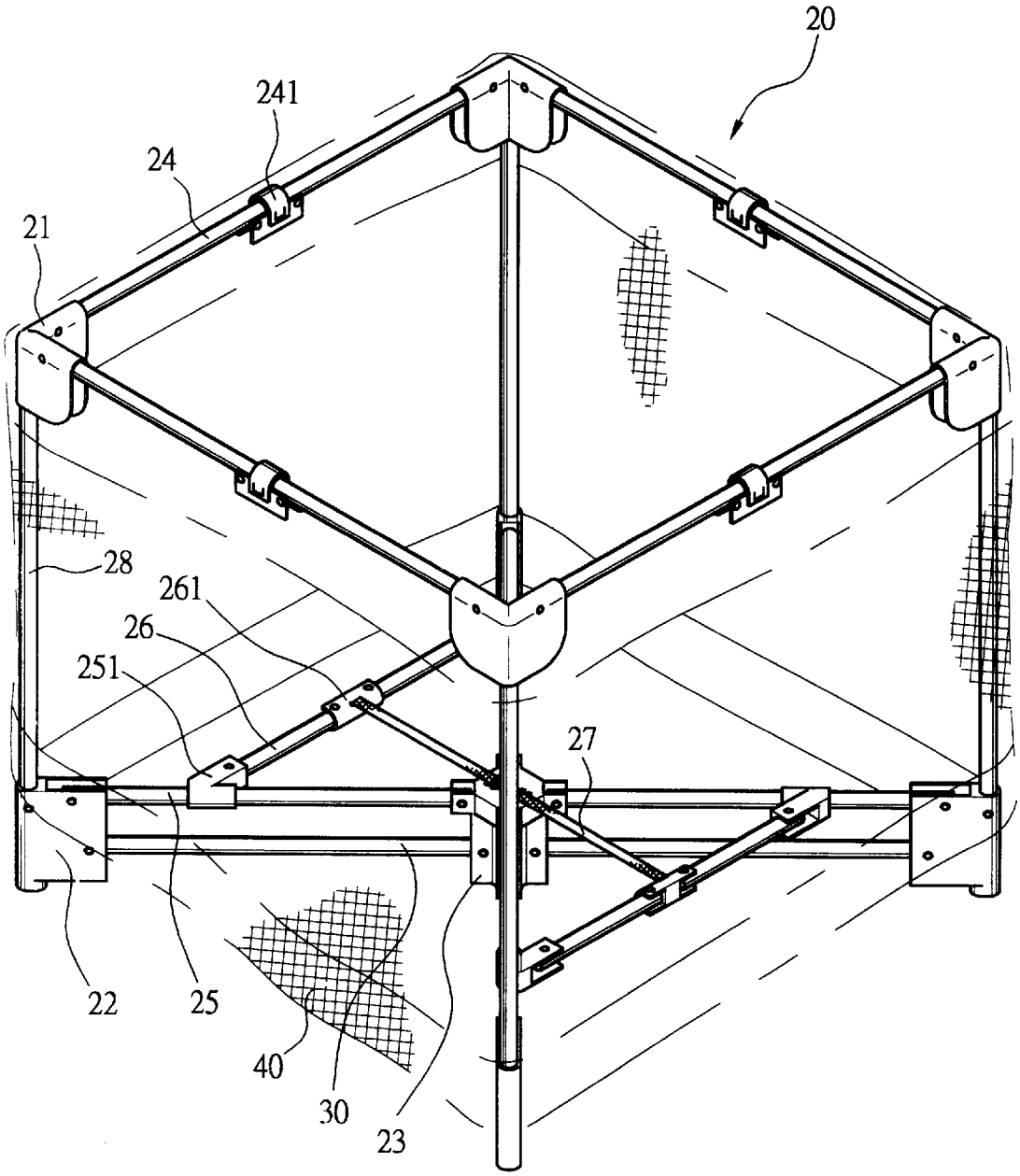
FIG. 3 is a perspective view to show a first preferred embodiment of the present invention.
Figure 4:
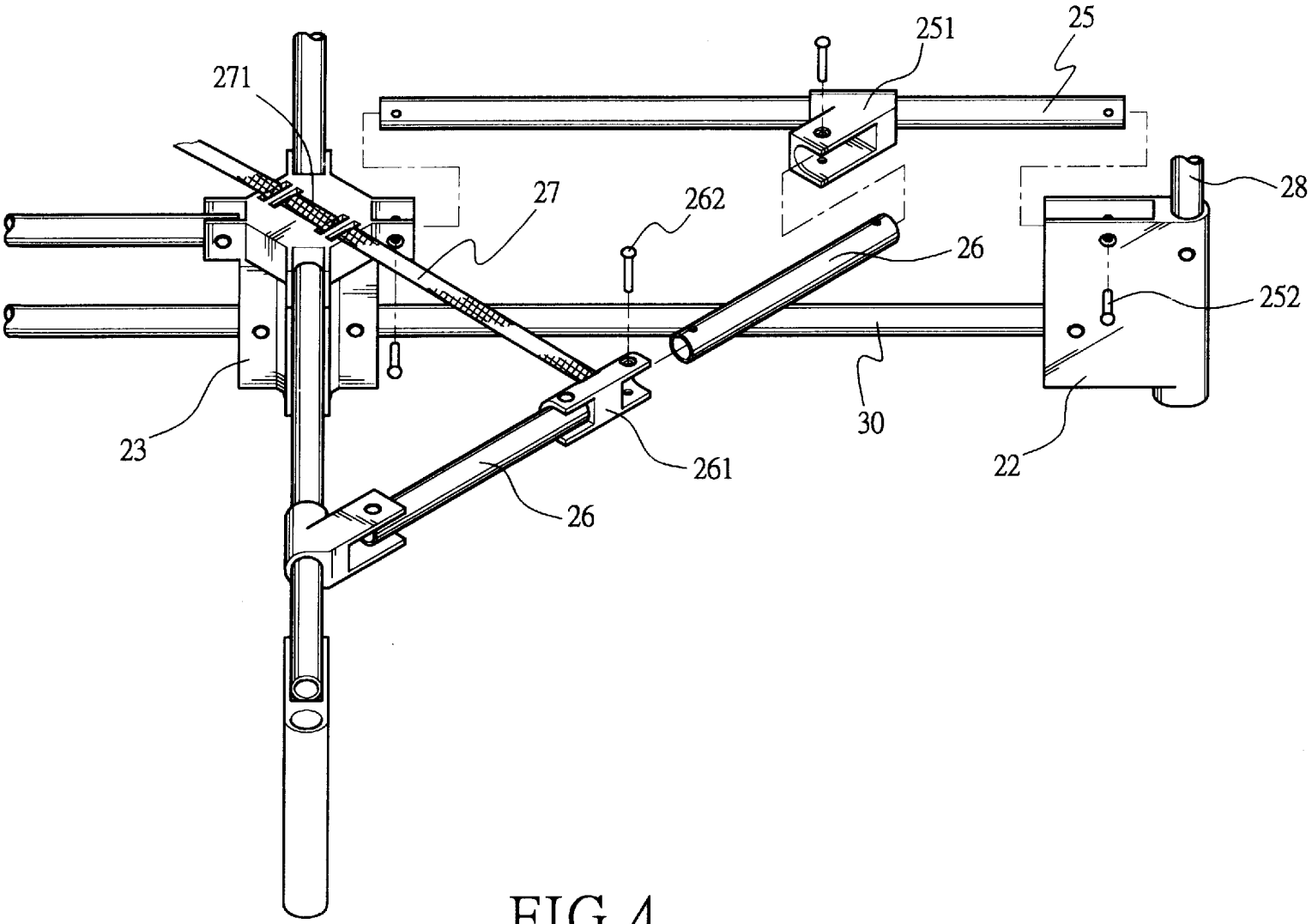
FIG. 4 is an exploded perspective view to show a lower portion of the first preferred embodiment of FIG. 3.

With reference to FIGS. 3 and 4 of the drawings, the collapsible playpen 20 of the present invention comprises four upper corner seats 21, four lower corner seats 22, four vertical posts 28 respectively secured to the upper and lower corner seats 21 and 22, four upper railings 24 pivotally connected to the four upper corner seats 21 respectively so as to define a structure of rectangular configuration, a central seat 23 placed in the center of the playpen 20, four drive rods 25 oriented diagonally and each pivoted to the central seat 23 and the four lower corner seats 22, a pair of linking rods 26 parallel and respectively connected to an adapter 251 on each of the drive rods 25, a strip 27 connected to a connector 261 at a middle portion of each of the linking rods 26 and through a hook on the top of the central seat 23, four reinforcement rods 30 oriented diagonally and each pivoted to the central seat 23 and to-lower corner seats 22, and a casing 40 attached to the peripheral portion and the bottom portion of the playpen and placed above the top of the central seat.

The upper corner seats 21 have a generally V-shaped hollow interior body composed of two identical inverse U-shaped extensions perpendicular to each other and a first vertical recess at the conjunction point of the V-shaped extensions facing downward to receive the upper ends of the vertical posts 28. Each of the inverse U-shaped extensions includes a pair of aligned thru holes in the lateral walls thereof to pivotally engage with the outer ends of the upper railing 24, which is composed of two rods of equal length, which are pivotally connected at their inner ends to a fist connecter 241 so that the upper railings 24 may be bent downward in a roughly V-shaped configuration when the playpen collapses.

The lower corner seats 22 each includes a second vertical recess facing upward to receive the lower ends of the vertical posts 28 and a flat U-shaped extension oriented inward of the playpen 20. The flat U-shaped extension includes a pair of aligned thru holes in the upper lateral walls thereof to allow pivot the outer ends of the drive rods 25 by an axial pin 252. A pair of aligned thru holes in the lower lateral walls allow pivoting of the outer ends of the reinforcement 30.

The central seat 23 includes a substantially octagonal upper portion, a rectangular lower portion, four first lugs extended perpendicularly outward there from each having a pair of aligned thru holes to allow pivoting of the inner ends of the drive rods 25, four second lugs extended perpendicularly outward from the lower portion thereof to allow pivoting of the inner ends of the reinforcement rods 30.

The adapter 251 includes a tubular body frictionally engaged with each of the drive rods 25 and a skewed U-shaped extension which engages the linking rods 26 so as to allow pivoting of the outer ends of the linking rods 26. The rods 26 include two rods of equal length joined by and pivotally to a connecter 261.

A strip 27 connects to the connecters 261 and extends through a pair of hooks on the top of the central seat 23 to define a pulling portion 271 between the hooks.

Based on the above discussed embodiment the vertical posts 28 will not fall inward because of the addition of the reinforcement rods 30 which provide appropriate support to prevent the top of the vertical posts 28 from inward movement. Thus the playpen 20 will not be inadvertently collapsed if the upper railing 24 is bent downward.

Figure 5:
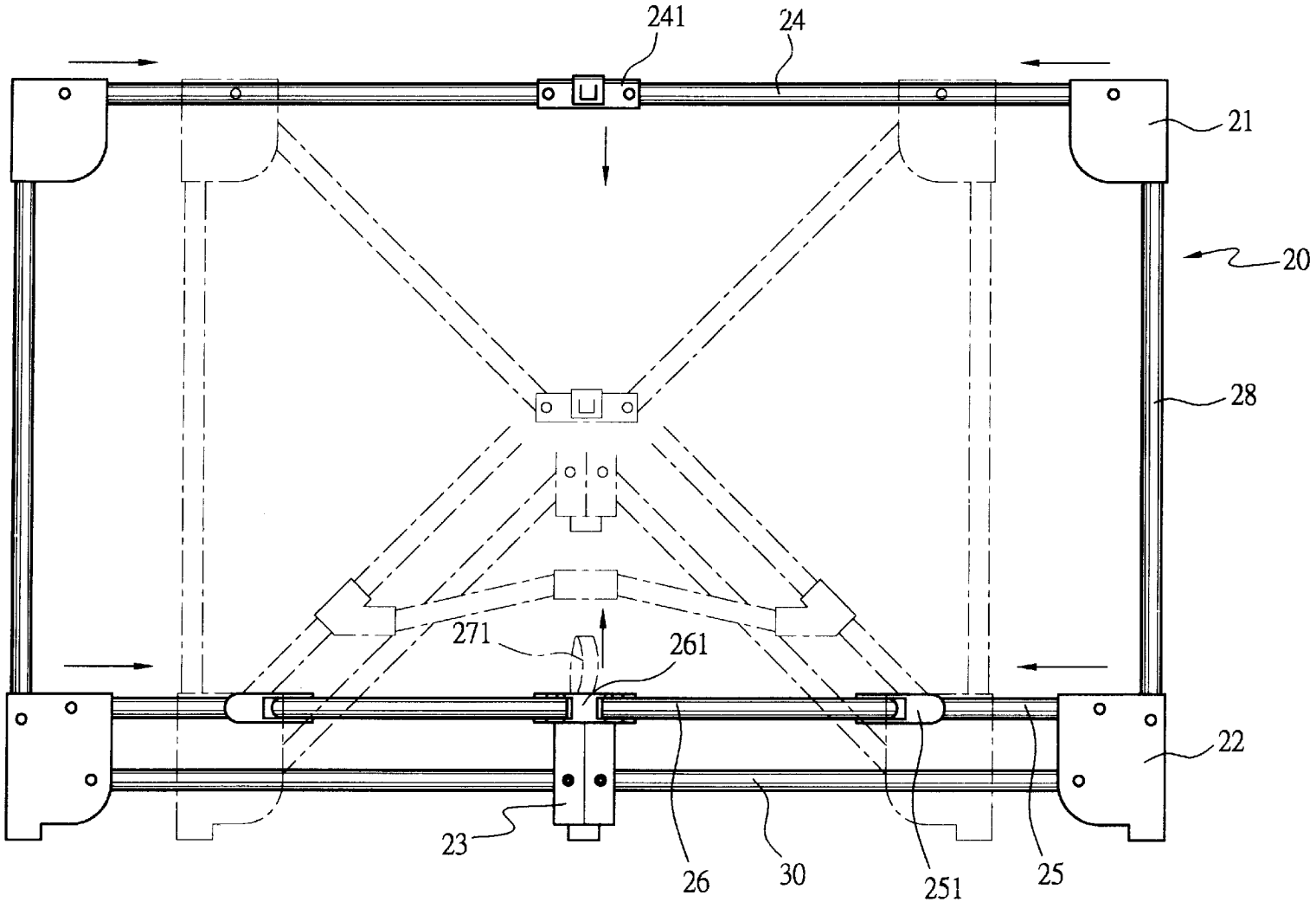
FIG. 5 is a side view of FIG. 3 showing collapse of the playpen.
Figure 6:
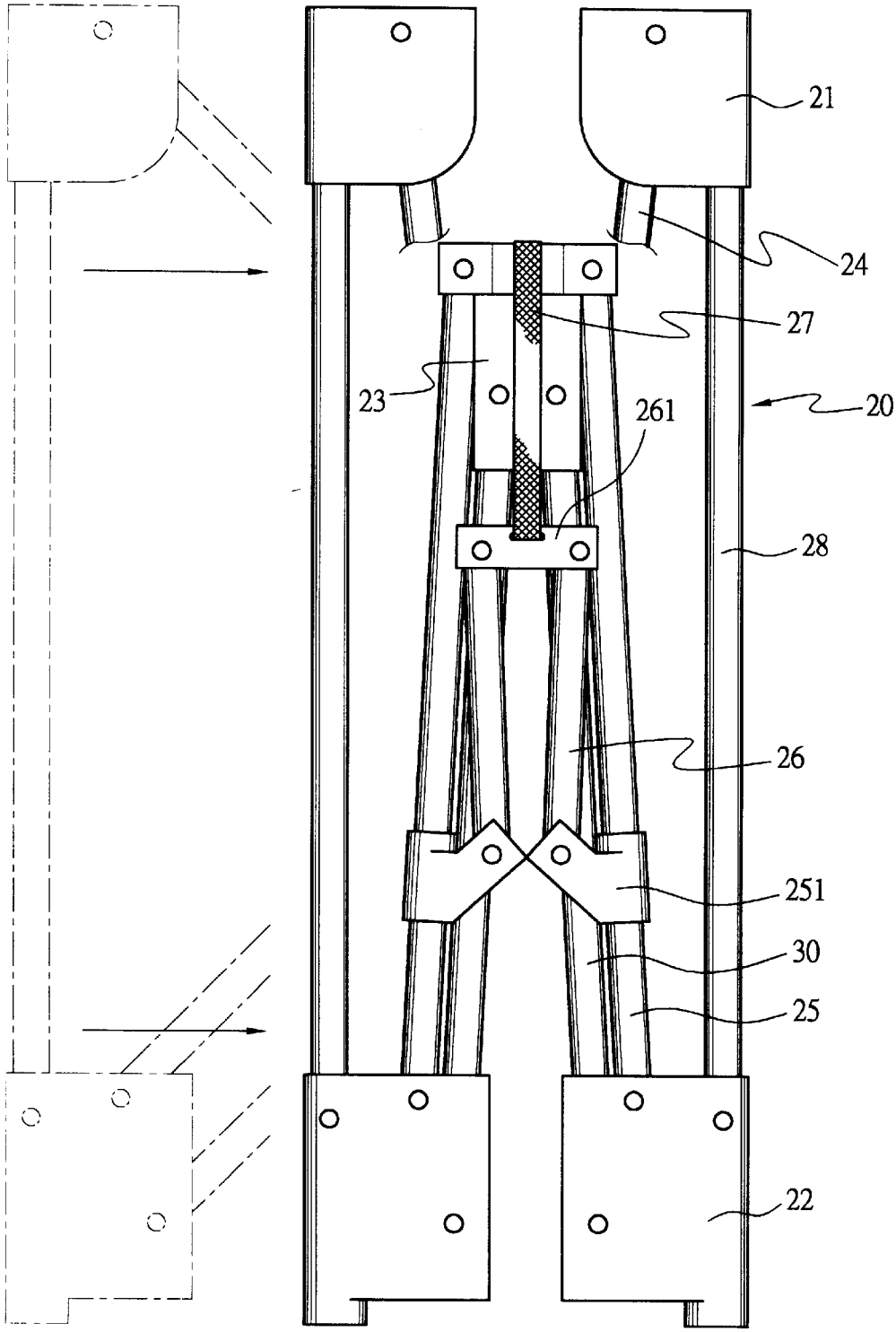
FIG. 6 is a vertical view indicating a collapsed state of the playpen according to the present invention.

Referring to FIGS. 5 and 6, to fold the playpen 20 the pulling portion 271 of the strip 27 is pulled upward which cause the central seat 23 to move upward. All the ining rods 26, the drive rods 25 and the reinforcement rods 70 are bent upward to become inverse V-shapes (as shown in the broken lines of FIG. 5). The connecter 241 of the upper railings 24 is pushed downward so that the playpen 20 is collapsed into a rectangular configuration (as shown in FIG. 6). When expanding the playpen the user operates the above steps conversely.

Figure 7:
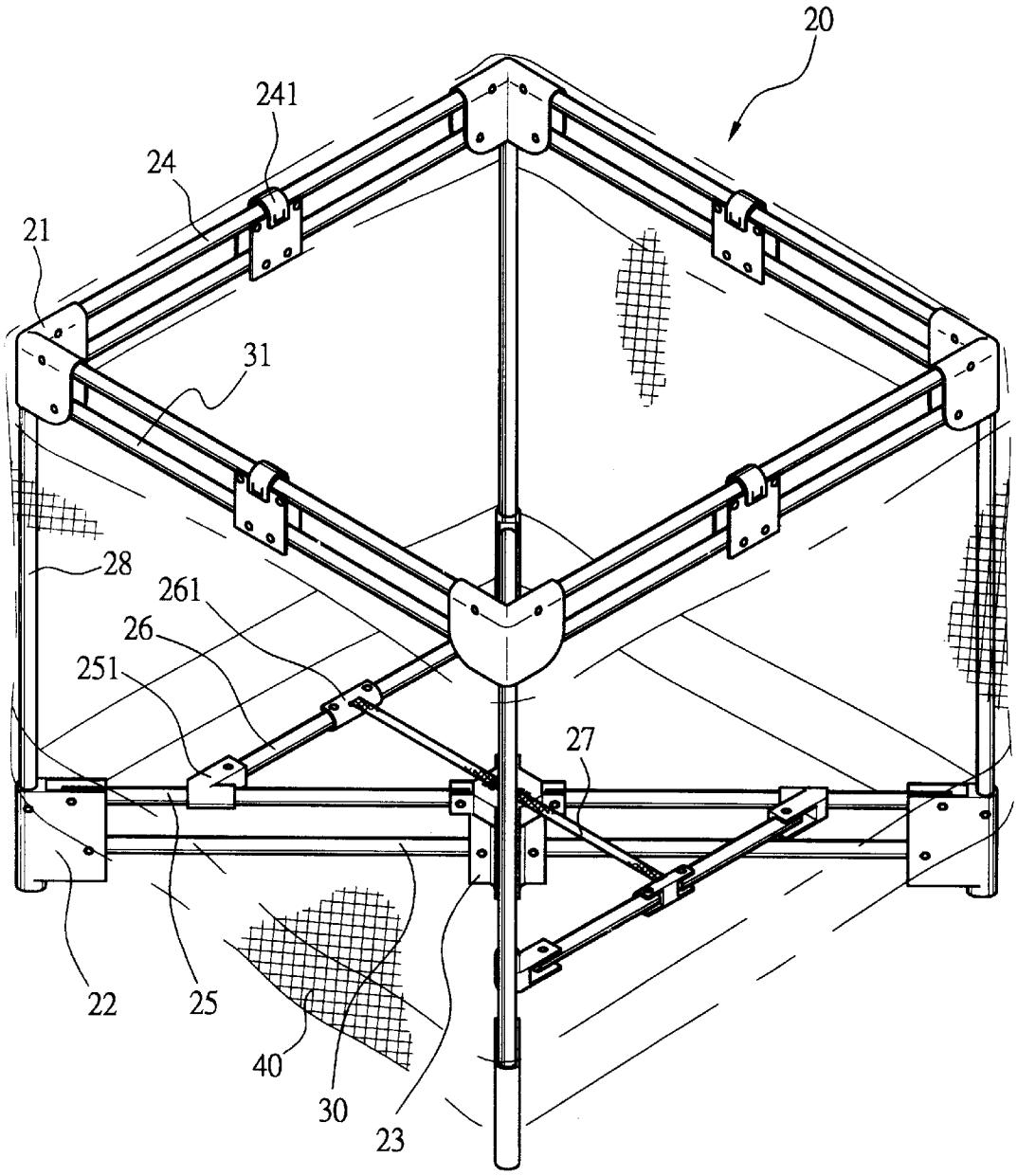
FIG. 7 is a perspective view to show a second preferred embodiment of the present invention.

Referring to FIG. 7, a second embodiment of the playpen 20 of the present invention is provided in which the structure and function are mostly similar to the above embodiment described in FIGS. 3–6 and the above discussions are applicable in most instances. The only modification is that a second reinforcement rod 31 is disposed under each of the upper railings 24. Each of the second reinforcement rods 31 includes two rods of equal length which have an inner end pivoted to the first connecter 241 an outer end pivoted to the upper corner seat 21. The second reinforcement rods 31 can be bent downward together with the upper railings 24.

Figure 8:
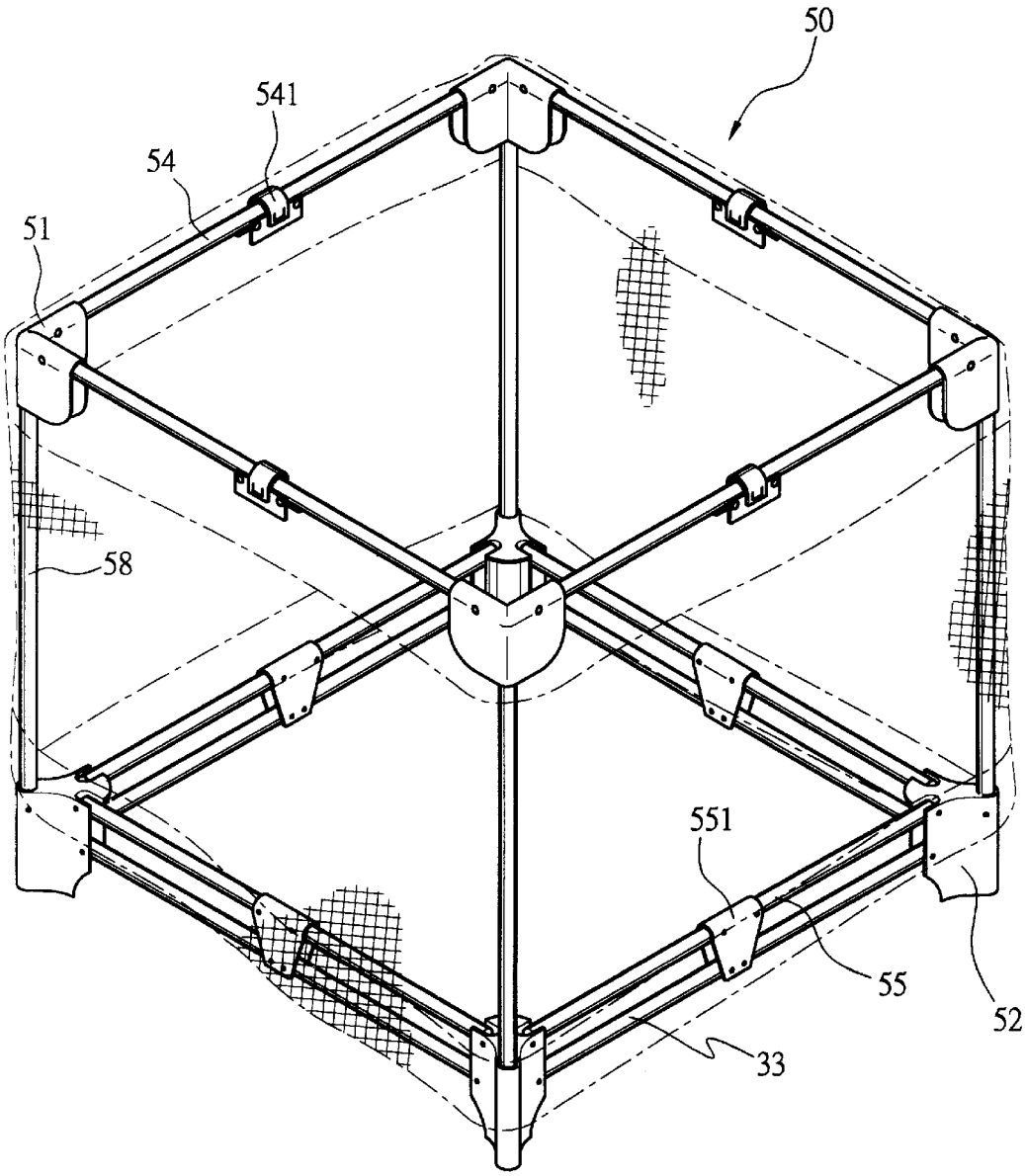
FIG. 8 is a perspective view to show a third preferred embodiment of the present invention.

Referring to FIG. 8, a third embodiment of the playpen of the present invention is provided, which is generally a conventional playpen 50 of rectangular structure and includes four upper corner seats 51, four lower corner seats 52, four upper railings 54 pivoted at the four upper corner seats 51, four lower rods 55 including four reinforcement rods thereunder pivoted at the four lower corner seats 52 and four vertical posts 58 respectively secured in the upper and lower corner seats 51 and 52. Each of the upper railings 54 includes a pair of rods of equal length which are pivoted at their inner ends to a first connecter 541. Both the lower rods 55 and the reinforcement rods 33 each include two rods of equal length which are pivoted at their inner ends to a second connecter 551. To fold the playpen the upper railings 54 are pusheddownward, and the lower rods 55 together with the reinforcement rods 33 are pushed upward so as to cause the four vertical posts 58 to move centripetally to therefore the playpen 50. In order to expand the playpen 50 the steps are followed in reverse This embodiment is simple in structure and durable because of the addition of the reinforcement rods 33.

Figure 9:
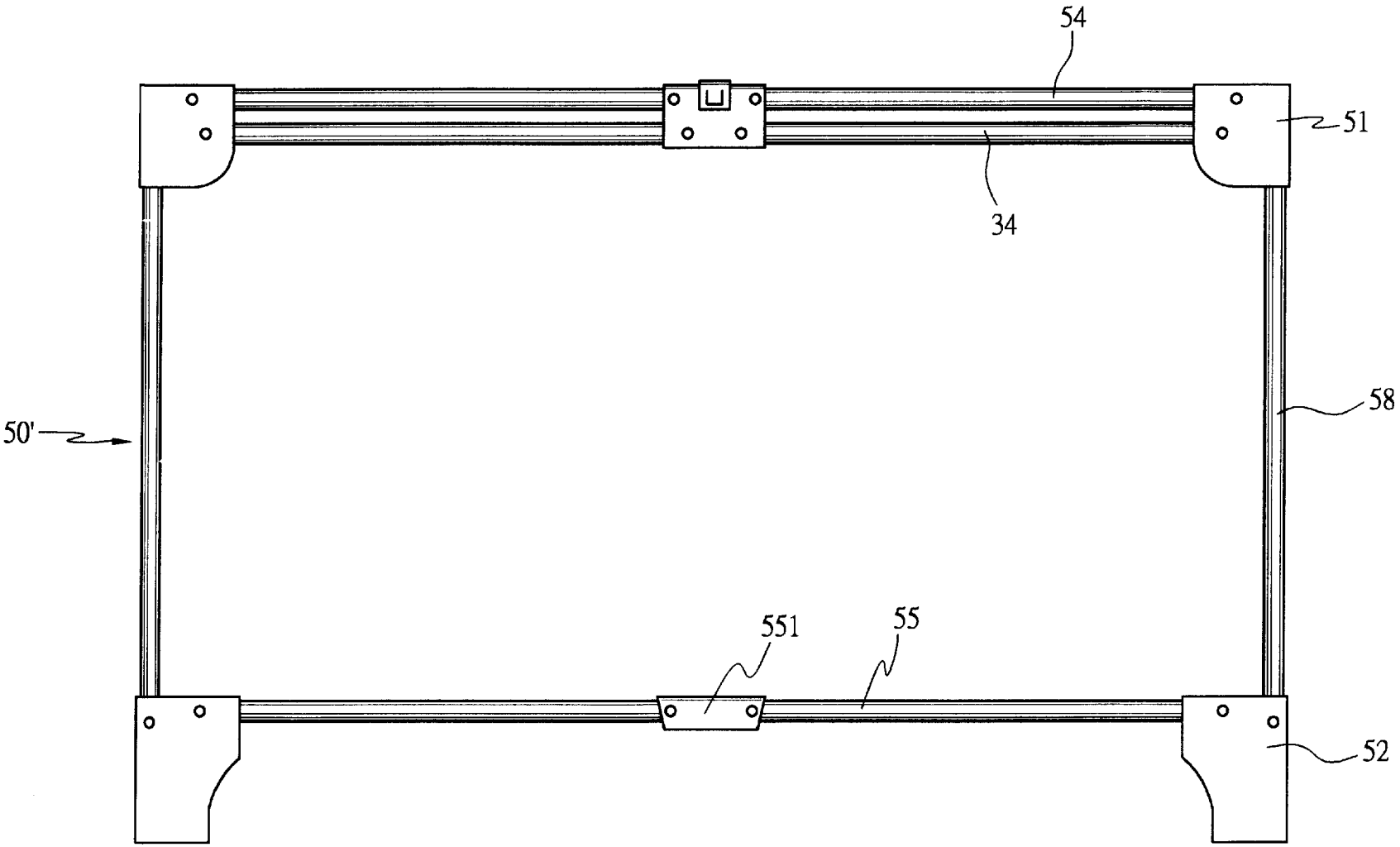
FIG. 9 is a side view to show a fourth preferred embodiment of the present invention.

Referring to FIG. 9, a fourth embodiment of the playpen 50' of the present invention is shown which is only an alternative of the third embodiment described in FIG. 8. The only difference is that the reinforcement rods 33 under the lower rods 55 are removed and instead reinforcements 34 are pivotally disposed under the upper railings 54. This change provides the same durability to the playpen 50.

The specification relating to the above embodiments should be construed as exemplary rather than as limitating, with many variations and modifications being readily attainable by a person of average skill in the art without departing from the spirit or scope of the invention defined by the appended claims and their legal equivalents.

What is claimed is:

1. A collapsible playpen comprising:

four upper corner seats each including a V-shaped body of hollow interior having a pair of identical inverse U-shaped extensions perpendicular to each other, a first vertical recess at a conjunction point of the U-shaped extensions facing downward, said inverse U-shaped extensions each having a plurality of aligned thru holes formed in upper and lower lateral walls thereof;

four lower corner seats each including a hollow flat body, a second vertical recess in one end of the body facing upward and a flat U-shaped extension extending outward from the second recess having a plurality of aligned thru holes in upper and lower lateral walls thereof;

four vertical posts each having an upper end secured to a respective first vertical recess of each of said upper corner seats and a lower end secured to a respective second vertical recess of each of said lower corner seats; four upper railings each comprising a pair of identical rods each having an outward end and an inward end, the outward ends being pivoted at the aligned thru holes in the upper lateral walls of the inverse U-shaped extension of said upper corner seats, the inward ends being pivoted to first connectors;

a central seat positioned underneath said playpen and having an octagonal upper portion, a rectangular lower portion, four first lugs extended perpendicularly outward from the upper portion thereof, four second lugs extended perpendicularly outward from the lower portion thereof and a pair of hooks formed spaced apart on a top of the upper portion, said first and second lugs each having a pair of aligned thru holes in lateral walls thereof;

four drive rods oriented diagonally and each having inward ends pivoted to the first lugs of said central seat and outward ends pivoted to an upper portion of the flat U-shaped extensions of said lower corner seats respectively and each drive rod having an adapter sleeved on and in the proximity of the outward ends thereof, said adapters each including a tubular body, a skewed extension which has a U-shaped section extended outward from a lateral side of the tubular body and a pair of aligned thru holes in the lateral walls of the skewed extension;

a pair of linking rods each comprising two rods of equal length each having an outward end and an inward end, the inward ends being pivoted to second connectors, the outward ends being pivoted to the skewed extensions of the adapters;

a strip having two ends respectively connected to the second connectors of said linking rods and extended through the hooks of said central seat to define a pulling portion therebetween;

four reinforcement rods disposed under said drive rods, each having an inward end pivoted to the second lugs of said central seat and an outward end pivoted to the lower walls of the flat U-shaped extensions of said lower corner seat respectively;

a casing attached to a peripheral portion of said playpen including a bottom positioned above said central seat;

whereby said playpen is collapsed by simultaneously pulling up the pulling portion of said strip and pushing down the upper railings.

2. A collapsible playpen comprising:

four upper corner seats each including a V-shaped body of hollow interior having a pair of identical inverse U-shaped extensions perpendicular to each other, a first vertical recess at a conjunction point of the U-shaped extensions facing downward, said inverse U-shaped extensions each having a plurality of aligned thru holes formed in upper and lower lateral walls thereof;

four lower corner seats each including a hollow flat body, a second vertical recess in one end of the body facing upward and a flat U-shaped extension extending outward from the second recess having a plurality of aligned thru holes in upper and lower lateral walls thereof;

four vertical posts each having an upper end secured to a respective first vertical recess of each of said upper corner seats and a lower end secured to a respective second vertical recess of each of said lower corner seats; four upper railings each comprising a pair of identical rods each having an outward end and an inward end, the outward ends being pivoted at the aligned thru holes in the upper lateral walls of the inverse U-shaped extension of said upper corner seats, the inward ends being pivoted to first connectors;

a central seat positioned underneath said playpen and having an octagonal upper portion, a rectangular lower portion, four first lugs extended perpendicularly outward from the upper portion thereof, four second lugs extended perpendicularly outward from the lower portion thereof and a pair of hooks formed spaced apart on a top of the upper portion, said first and second lugs each having a pair of aligned thru holes in lateral walls thereof;

four drive rods oriented diagonally and each having inward ends pivoted to the first lugs of said central seat and outward ends pivoted to an upper portion of the flat U-shaped extensions of said lower corner seats respectively and each drive rod having an adapter sleeved on and in the proximity of the outward ends thereof, said adapters each including a tubular body, a skewed extension which has a U-shaped section extended outward from a lateral side of the tubular body and a pair of aligned thru holes in the lateral walls of the skewed extension;

a pair of linking rods each comprising two rods of equal length each having an outward end and an inward end, the inward ends being pivoted to second connectors, the outward ends being pivoted to the skewed extensions of the adapters;

a strip having two ends respectively connected to the second connectors of said linking rods and extended through the hooks of said central seat to define a pulling portion therebetween;

four reinforcement rods disposed under said upper railings each having an inward end pivoted to a respective first connector and an outward end pivoted to the lower walls of the inverse U-shaped extensions of said upper corner seat respectively;

a casing attached to a peripheral portion of said playpen including a bottom positioned above said central seat;

whereby said playpen is collapsed by simultaneously pulling up the pulling portion of said strip and pushing down the upper railings.

3. A collapsible playpen comprising:

four upper corner seats;

four lower corner seats;

four vertical posts each having an upper end secured to a respective upper corner seat and a lower end secured to a respective lower corner seat;

four upper railings each comprising a pair of identical length rods each having an outward end and an inward end, the outward ends being pivoted to an upper portion of said upper corner seats respectively, the inward ends respectively pivoted to first connectors;

four lower railings each comprising a pair of identical length rods each having an outward end and an inward end, the outward ends being pivoted to an upper portion of said lower corner seats respectively, the inward ends respectively pivoted to an upper portion of second connectors;

four reinforcement rods disposed under said lower railings respectively, said reinforcement rods each comprising a pair of identical length rods each having an outward end and an inward end, the outward ends being pivoted to a lower portion of said lower corner seats respectively, the inward ends being pivoted to a lower portion of said second connectors;

a casing attached to a peripheral portion of said playpen including a bottom positioned under said first reinforcement rods;

whereby said playpen is collapsed by simultaneously pushing said upper railings downward and pushing said lower railings together with said first reinforcement rods upward.

4. A collapsible playpen comprising:

four upper corner seats;

four lower corner seats;

four vertical posts each having an upper end secured to a respective upper corner seat and a lower end secured to a respective lower corner seat;

four upper railings each comprising a pair of identical length rods each having an outward end and an inward end, the outward ends being pivoted to an upper portion of said upper corner seats respectively, the inward ends respectively pivoted to first connectors;

four lower railings each comprising a pair of identical length rods each having an outward end and an inward end, the outward ends being pivoted to an upper portion of said lower corner seats respectively, the inward ends respectively pivoted to an upper portion of second connectors;

four reinforcement rods disposed under said upper railings respectively, said reinforcement rods each comprising a pair of identical length rods each having an outward end and an inward end, the outward ends being pivoted to a lower portion of said upper corner seats respectively, the inward ends being pivoted to a lower portion of said first connectors;

whereby said playpen is collapsed by simultaneously pushing said upper railings downward and pushing said lower railings together with said first reinforcement rods upward.

* * * * *